US006415968B1

(12) United States Patent
Kolton et al.

(10) Patent No.: US 6,415,968 B1
(45) Date of Patent: Jul. 9, 2002

(54) GARMENT HANGER

(75) Inventors: Chester Kolton, Westfield; Michael Norman, East Brunswick, both of NJ (US); Robert Whittemore, Middletown, NY (US)

(73) Assignee: B&G Plastics, Inc., Newark, NJ (US)

( * ) Notice: Subject to any disclaimer, the term of this patent is extended or adjusted under 35 U.S.C. 154(b) by 0 days.

(21) Appl. No.: 09/905,020

(22) Filed: Jul. 13, 2001

(51) Int. Cl.[7] ..... A47G 25/48
(52) U.S. Cl. ..... 223/96; 223/93; 24/543
(58) Field of Search ..... 223/90, 91, 93, 223/96, 85, 88; 24/543

(56) References Cited

U.S. PATENT DOCUMENTS

D146,998 S * 6/1947 Townsend et al. ..... 223/96
3,698,043 A * 10/1972 Batts ..... 223/91
5,400,932 A * 3/1995 Hollis ..... 223/96
6,019,261 A * 2/2000 Morgan et al. ..... 223/96
6,119,906 A * 9/2000 Bond et al. ..... 223/96

* cited by examiner

*Primary Examiner*—Bibhu Mohanty
(74) *Attorney, Agent, or Firm*—Robin, Blecker & Daley

(57) ABSTRACT

A hanger for articles includes a body defining a support element, first and second clamp members supported by the support element for pivotal closing movement onto one another and locking structure releasably retaining the first and second clamp members in mutually closed relation, the body further defining guard structure aside the locking structure for limiting access thereto.

16 Claims, 3 Drawing Sheets

GARMENT HANGER

FIELD OF THE INVENTION

This invention relates generally to hangers for article display and pertains more particularly to hangers adapted to engage articles at plural, spaced portions thereof

BACKGROUND OF THE INVENTION

FIGS. 1–3 depict molded hanger 10 manufactured and sold by the assignee of the subject application. Hanger 10 is single-piece molded plastic body having a hook portion 12, a first clamp member 14 and a second clamp member 16 joined to one another by hinge portions 18 and 20. Clamp member 16 is folded about the hinge portions as shown in FIGS. 2 and 3 and latching member 22 formed on clamp member 14 passes through opening 24 of clamp member 16 and includes downwardly extending latch element or keeper (not shown) which maintains the clamp members in mutually abutting relation with gripping teeth 26 and 28, formed interiorly of the clamp members, in mutual engagement with an article (not shown) disposed therebetween.

The hanger of FIGS. 1–3 was made and sold with license under U.S. Pat. No. 3,698,043 and U.S. Pat. No. 3,665,563, both now expired.

The hanger of FIGS. 1–3 and the hangers disclosed in the two expired patents are for attachment to an article at a single location thereof, i.e., the hangers are individually and not jointly usable. On the other hand, the '563 patent does contemplate that the clamps be jointly displayable. Thus, the '563 patent discloses "a passage or tunnel 25 opening through the ends of the clamp to receive a support such as the rod 26" (Col. 2, ls. 8–9).

Applicants herein have noted a difficulty in use of the hanger of FIGS. 1–3, namely, that, where plural hangers, each supporting an article are applied to a display rod in dense packing, clamp members 14 of the clamps engage with latching members 22 of adjacent clamps, causing the clamp members to open and to fail to retain the articles therein for display.

SUMMARY OF THE INVENTION

The present invention has as its primary object the provision of improved hangers generally of the type shown in FIGS. 1–3, but which do not have the above-discussed difficulty in use.

A further object of the invention is to provide hangers of the foregoing type but adapted for attachment to an article at plural locations thereon.

A more particular object of the invention is to provide hangers having clamps configured to contain a first, thickened portion of an article therewithin and to grippingly engage the article at a less thick portion of the article.

In attaining the first-stated object, the invention provides a hanger for articles comprising a body defining a support element, first and second clamp members supported by the support element for pivotal closing movement onto one another and locking means for releasably retaining said first and second clamp members in mutually closed relation, the body further defining guard structure aside the locking means for limiting access thereto.

In attaining the second-stated object, the invention provides a hanger for articles comprising a body defining a support element having transversely spaced first and second ends, first and second clamp members supported by the support element respectively at the first and second ends thereof third and fourth clamp members joined respectively to the first and second clamp members and supported thereby for pivotal closing movement onto the first and second clamp members and first and second locking means for releasably retaining the first and third and the second and fourth clamp members in mutually closed relation, the body further defining guard structure aside each of the locking means for limiting access thereto.

The pivotal closing movements of the third clamp member onto the first clamp member and of the fourth clamp member onto the second clamp member are afforded by hinge sections joining the third and fourth clamp members respectively to the first and second clamp members. Each of the clamp members defines a free end and includes article gripping members at the free end.

In attaining the third above-stated object, the hanger of the invention spaces the gripping members of plural clamps from latching members of the clamps by a dimension corresponding to a dimension of a portion of an article having a first thickness, whereby the gripping members grip the article at a portion thereof of a second thickness, lesser than the first thickness.

The foregoing and other objects and features of the invention will be further evident from the following detailed description of preferred embodiments thereof and from the drawings in which like components are identified by like reference numerals throughout.

DETAILED DESCRIPTION OF THE PREFERRED EMBODIMENT AND PRACTICE

Figure 3:
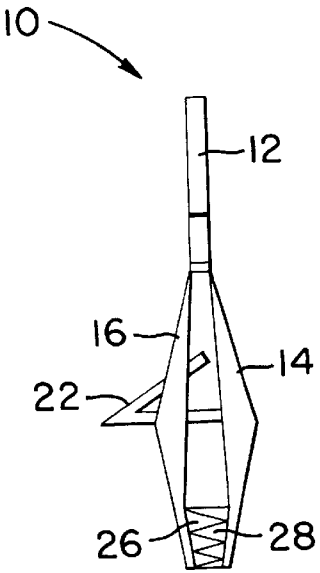
FIG. 3 (PRIOR ART)
FIG. 3 is a right side elevation of FIG. 2.
Figure 2:
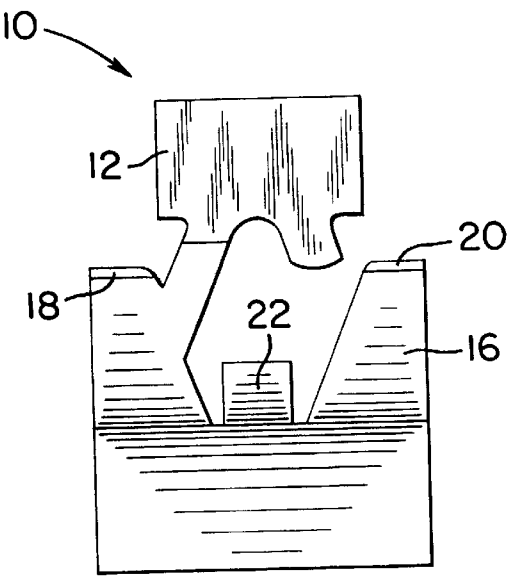
FIG. 2 (PRIOR ART)
FIG. 2 is a front elevation of the FIG. 1 hanger upon folding of the clamp members upon one another.
Figure 1:
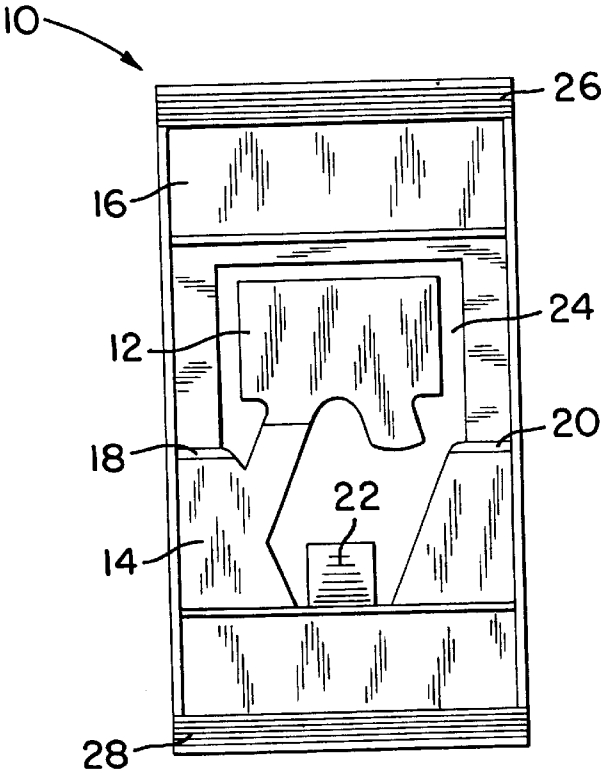
FIG. 1 (PRIOR ART)
FIG. 1 is a front elevational view of a known hanger prior to folding of the clamp members thereof.
Figure 5:
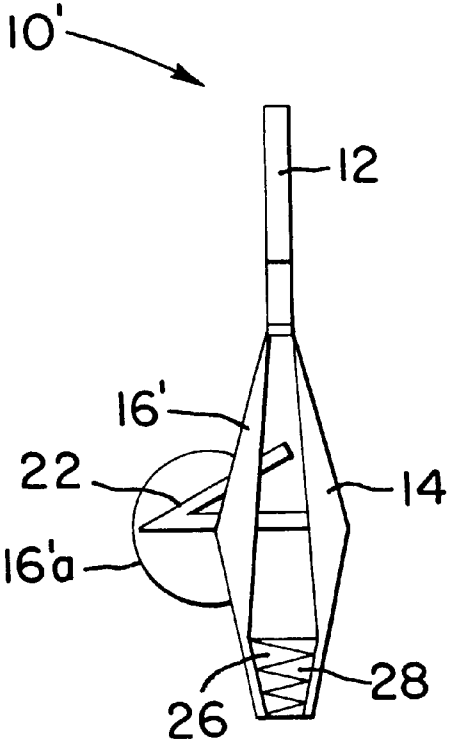
FIG. 5 is a right side elevation of FIG. 4.
Figure 4:
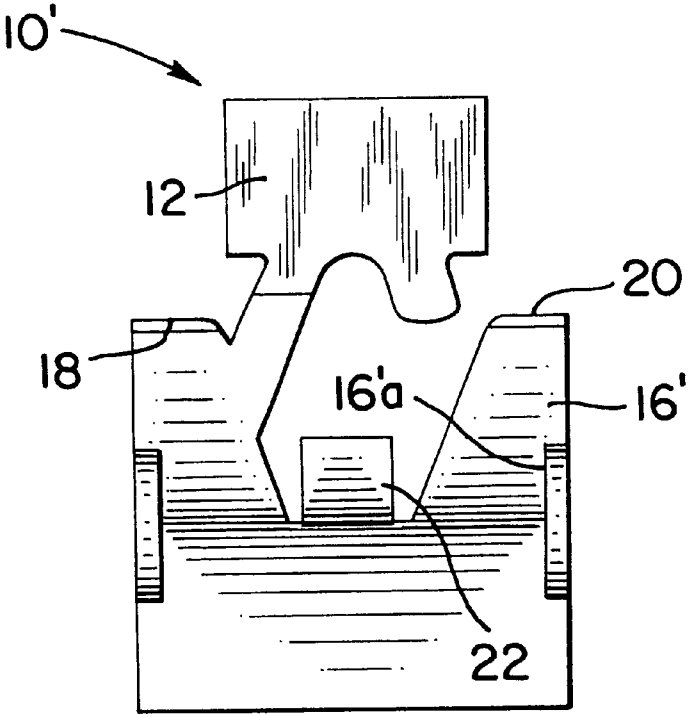
FIG. 4 is a front elevation of a first embodiment of a hanger in accordance with the invention.

Referring to FIGS. 4 and 5, housing 10' is single-piece molded plastic body having various components of the hanger of FIGS. 1–3, including hook portion 12, first clamp member 14 and second clamp member 16' joined to one another by hinge portions 18 and 20. Clamp member 16 is folded about the hinge portions as shown in FIGS. 2 and 3 and latching member 22 formed on clamp member 14 passes through opening 24 of clamp member 16 and includes a downwardly extending latch element or keeper (not shown) which maintains the clamp members in mutually abutting relation with gripping teeth 26 and 28, formed interiorly of the clamp members, in mutual engagement with an article (not shown) disposed therebetween.

Clamp member 16' differs from clamp member 16 in defining guard structure in the form of curved projections extending outwardly, aside latching member 22, one projection being shown at 16". The projections extend beyond latching member 22, whereby latching member 22 is not exposed to unintentional release by an adjacently disposed hanger when plural hangers are densely packed on a common display rod.

Figure 7:
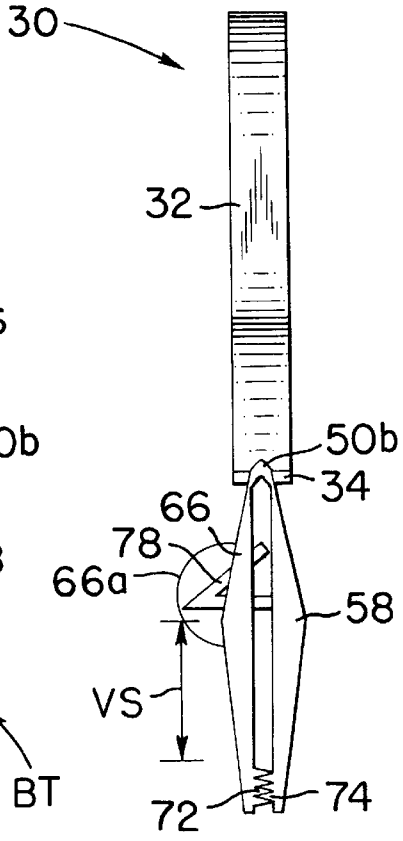
FIG. 7 is a side elevation of FIG. 6.
Figure 6:
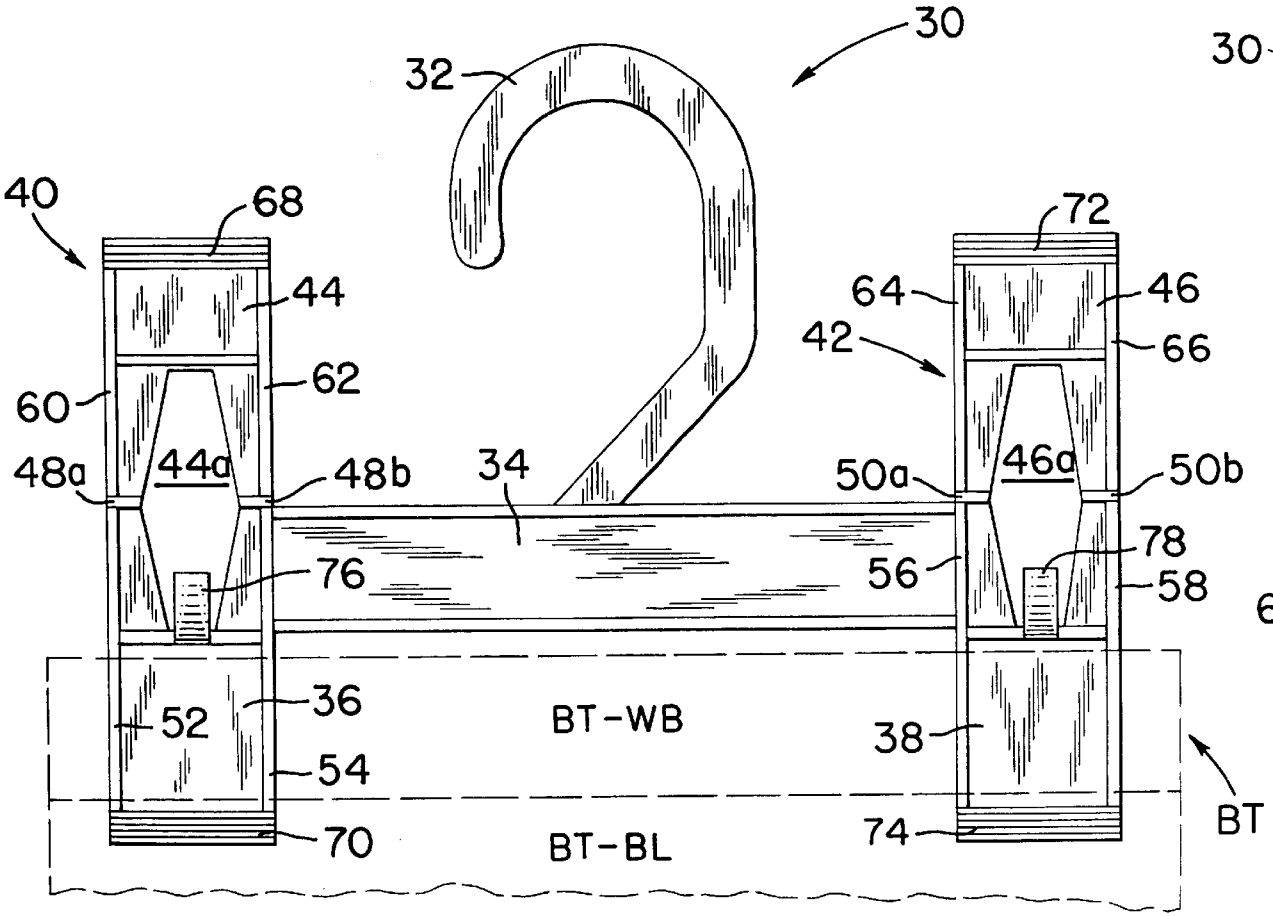
FIG. 6 is a front elevation of a second embodiment of a hanger in accordance with the invention with phantom lines indicating a garment in registry with the lower clamp members of the hanger.

Referring to FIGS. 6 and 7, hanger 30 of the subject invention includes hook portion 32 extending upwardly of transversely extending support member 34. At its respective transverse ends, support member supports first and second clamp members 36 and 38 of clamps 40 and 42. Third and fourth clamp members 44 and 46 are supported for pivotal movements onto the first and second clamp members by respective hinges 48*a*, 48*b* and 50*a*, 50*b*. Clamp members 36 and 38 include vertical ribs 52, 54, 56 and 58. Clamp members 44 and 46 include vertical ribs 60, 62, 64 and 66. Clamp gripping elements are indicated at 68, 70, 72 and 74.

Latching members 76 and 78 extend from clamp members 36 and 38 and clamp members 44 and 46 define openings 44*a* and 46*a* for passage of latching members 76 and 78 therethrough and latch elements (not shown) depend downwardly of latching members 76 and 78 to releasably, lockingly engage clamp members 44 and 46 downwardly adjacently of openings 44*a* and 46*a*.

Guard structures in the form of curved projections extend outwardly of vertical ribs 64 and 66, aside each of latching members 76 and 78, one projection being shown at 66*a* in FIG. 7. The projections extend beyond latching members 76 and 78, whereby latching members 76 and 78 are not exposed to unintentional release by an adjacently disposed hanger when plural hangers are densely packed on a common display rod.

In contrast to the single article location engagement of the hanger of FIGS. 1–3 and the cited patents, the hanger of FIGS. 6 and 7, through its inclusion of a support member of preselected transverse dimension and its spacing of plural clamp members from one another by such preselected transverse dimension, provides for plural article engagement locations.

In FIG. 6, a bathing trunks BT is shown in phantom in registry with first and second clamp members 36 and 38. The bathing trunks have a thickened waistband portion BT-WB and a less thick body-leg portion BT-BL. The hanger is dimensioned in its support member 34 such that clamp members 36 and 38 are disposed at or near the transverse margins of waistband portion BT-WB, i.e., mutually spaced by approximately the transverse dimension of bathing trunks BT. Further, the hanger is dimensioned such that the vertical spacing VS (FIG. 7) between latching members 76 and 78 and gripping elements 68, 70, 72 and 74 corresponds with the vertical dimension of waistband portion BT-WB. Accordingly, waistband portion BT-WB is nested between the clamp members and the gripping members engage body-leg portion BT-BL. Vertical ribs, e.g., ribs 58 and 66 (FIG. 7), are mutually spaced to adapt to the thickness of waistband portion BT-WB.

By way of summary and introduction to the ensuing claims, the invention will be seen to provide a hanger for articles comprising a body defining a support element, first and second clamp members supported by the support element for pivotal closing movement onto one another and locking means for releasably retaining said first and second clamp members in mutually closed relation, the body further defining guard structure aside the locking means for limiting access thereto.

Further, the invention will be seen to provide a hanger for articles comprising a body defining a support element having transversely spaced first and second ends, first and second clamp members supported by the support element respectively at the first and second ends thereof third and fourth clamp members joined respectively to the first and second clamp members and supported thereby for pivotal closing movement onto the first and second clamp members and first and second locking means for releasably retaining the first and third and the second and fourth clamp members in mutually closed relation, the body further defining guard structure aside the locking means for limiting access thereto.

The pivotal closing movement of the third clamp member onto the first clamp member is afforded by a first hinge section joining the third clamp member to the first clamp member and wherein the pivotal closing movement of the fourth clamp member onto the second clamp member is afforded by a second hinge section joining the fourth clamp member to the second clamp member.

Each of the clamp members defines a free end and includes article gripping members at the free end.

The first locking means includes a latch member pivotally supported by the first clamp member and a keeper defined in the third clamp member and the second locking means includes a further latch member pivotally supported by the second clamp member and a keeper defined in the fourth damp member.

The body further defines a hook portion extending outwardly of the support element at a location between the first and second clamp members.

Further, the invention provides a combination of an article having a given width and having a first thickened portion and a second portion depending from the article first portion and of lesser thickness than the article first portion and a hanger comprising a body defining first and second clamps supported at respective ends of a support member, the widthwise spacing between end margins of the clamps being approximately equal to the given article width, the clamps having latch members for releasably locking the clamps and having gripping elements, the gripping elements being vertically spaced from the latch members by a vertical dimension of the article first portion. The article first portion is disposed in the clamps between the latch members and the gripping elements and the gripping elements are in engagement with the article second portion.

Various changes to the particularly disclosed embodiment and practice may evidently be introduced without departing from the invention. Accordingly, it is to be appreciated that the particularly discussed and depicted preferred embodiment and practice of the invention are intended in an illustrative and not in a limiting sense. The true spirit and scope of the invention are set forth in the ensuing claims.

What is claimed is:

1. A hanger for articles comprising a body defining a support element, a first clamp member supported by the support element, a second clamp member supported by said first clamp member for pivotal closing movement onto said first clamp member and locking means for releasably retaining said first and second clamp members in mutually closed relation, said second clamp member defining guard structure aside the locking means for limiting access thereto.

2. The hanger claimed in claim 1, wherein said pivotal closing movement of said second clamp member onto said first clamp member is afforded by a hinge section joining said first clamp member to said second clamp member.

3. The hanger claimed in claim 1, wherein each of said clamp members defines a free end and includes article gripping members at said free end.

4. The hanger claimed in claim 1, wherein said locking means includes a latch member pivotally supported by said first clamp member and a keeper defined in said second clamp member.

5. The hanger claimed in claim 1, wherein said body further defines a hook portion extending outwardly of said support element.

6. A hanger for articles comprising a body defining a support element having transversely spaced first and second ends, first and second clamp members supported by said support element respectively at said first and second ends thereof third and fourth clamp members joined respectively to said first and second clamp members and supported thereby for pivotal closing movement onto said first and second clamp members and first and second locking means for releasably retaining said first and third and said second and fourth clamp members in mutually closed relation, each of said third and fourth clamp members defining guard structure aside the first and second locking means for limiting access thereto.

7. The hanger claimed in claim 6, wherein said pivotal closing movement of said third clamp member onto said first clamp member is afforded by a first hinge section joining said third clamp member to said first clamp member and wherein said pivotal closing movement of said fourth clamp member onto said second clamp member is afforded by a second hinge section joining said fourth clamp member to said second clamp member.

8. The hanger claimed in claim 6, wherein each of said clamp members defines a free end and includes article gripping members at said free end.

9. The hanger claimed in claim 8, wherein said pivotal closing movement of said third clamp member onto said first clamp member is afforded by a first hinge section joining said third clamp member to said first clamp member and wherein said pivotal closing movement of said fourth clamp member onto said second clamp member is afforded by a second hinge section joining said fourth clamp member to said second clamp member.

10. The hanger claimed in claim 6, wherein said first locking means includes a latch member pivotally supported by said first clamp member and a keeper defined in said third clamp member and wherein said second locking means includes a further latch member pivotally supported by said second clamp member and a keeper defined in said fourth clamp member.

11. The hanger claimed in claim 7, wherein said first locking means includes a latch member pivotally supported by said first clamp member and a keeper defined in said third clamp member and wherein said second locking means includes a farther latch member pivotally supported by said second clamp member and a keeper defined in said fourth clamp member.

12. The hanger claimed in claim 8, wherein said first locking means includes a latch member pivotally supported by said first clamp member and a keeper defined in said third clamp member and wherein said second locking means includes a further latch member pivotally supported by said second clamp member and a keeper defined in said fourth clamp member.

13. The hanger claimed in claim 6, wherein said body further defines a hook portion extending outwardly of said support element at a location between said first and second clamp members.

14. In combination:

(a) an article having a given width and having a first thickened portion and a second portion depending from said article first portion and of lesser thickness than said article first portion; and (b) a hanger comprising a body defining first and second clamps supported at respective ends of a support member, the widthwise spacing between end margins of said clamps being approximately equal to said given article width, said clamps having latch members for releasably locking said clamps and having gripping elements, said gripping elements being vertically spaced from said latch members by a vertical dimension of said article first portion, said article first portion being disposed in said clamps between said latch members and said gripping elements and said gripping elements being in engagement with said article second portion.

15. The invention claimed in claim 14, wherein said first and second clamps includes respective first and second clamp members supported by said support element and respective third and fourth clamp members joined respectively to said first and second clamp members and supported thereby for pivotal closing movement onto said first and second clamp members.

16. The invention claimed in claim 15, wherein said pivotal closing movement of said third clamp member onto said first clamp member is afforded by a first hinge section joining said third damp member to said first damp member and wherein said pivotal closing movement of said fourth clamp member onto said second clamp member is afforded by a second hinge section joining said fourth damp member to said second clamp member.

* * * * *

UNITED STATES PATENT AND TRADEMARK OFFICE

CERTIFICATE OF CORRECTION

PATENT NO. : 6,415,968 B1 
DATED : July 9, 2002
INVENTOR(S) : Chester Kolton, Michael Norman and Robert Whittemore It is certified that error appears in the above-identified patent and that said Letters Patent is hereby corrected as shown below:

Column 6,
Line 41, delete “third damp”and insert -- third clamp --.
Line 41, delete “first damp”and insert -- first clamp --.
Line 44, delete “damp”and insert -- clamp --.

Signed and Sealed this

Eleventh Day of March, 2003

JAMES E. ROGAN
*Director of the United States Patent and Trademark Office*